United States Patent [19]

Banich, Sr.

[11] 4,331,249

[45] May 25, 1982

[54] PLASTIC CLOSURE MEMBER WITH FLOWED-IN LINER

[75] Inventor: John N. Banich, Sr., Chicago, Ill.

[73] Assignee: The Continental Group, Inc., Stamford, Conn.

[21] Appl. No.: 242,196

[22] Filed: Mar. 10, 1981

[51] Int. Cl.[3] ..... B65D 53/00

[52] U.S. Cl. ..... 215/343; 215/352

[58] Field of Search ..... 215/343, 345, 352, 350

[56] References Cited

U.S. PATENT DOCUMENTS

| | | | |
|---|---|---|---|
| 3,189,209 | 6/1965 | Owens | 215/350 X |
| 3,435,976 | 4/1969 | Owens | 215/352 X |
| 4,308,965 | 1/1982 | Dutt | 215/345 |

FOREIGN PATENT DOCUMENTS

| | | | |
|---|---|---|---|
| 2451324 | 10/1980 | France | 215/343 |

*Primary Examiner*—Donald F. Norton

*Attorney, Agent, or Firm*—Charles E. Brown

[57] ABSTRACT

This relates to a closure member for containers wherein products are packaged under pressurized conditions. The closure member has a flowed-in liner, and in order to prevent relative movement between the liner and the closure member of the closure assembly, there is provided an interlock between the base of the liner and the base of a channel in which the liner is formed. This abstract forms no part of the specification of this application and is not to be construed as limiting the claims of the application.

4 Claims, 10 Drawing Figures

PLASTIC CLOSURE MEMBER WITH FLOWED-IN LINER

This invention relates in general to new and useful improvements in closures for containers and the like wherein the closures are provided with a flowed-in liner for the purpose of forming a seal with the neck finish of the container.

It is customary to provide closures for containers which are molded of plastic material and thereafter to form in situ within the closure an annular sealing member or liner. The liner is flowed-in and is not bonded to the plastic closure so as to prevent movement. Thus, movement of a flowed-in liner may be attributed to the lack of a chemical bond between the liner material and the material of the plastic closure, and separation or movement of the liner from the plastic closure due to the internal or external package pressure. This combination permits package pressure to leak out of the container such as in carbonated beverages, or air to leak into and spoil a hermetically sealed vacuum pack.

Normally, the liner is flowed-in to a channel formed on the underside of an end panel of the closure member. In accordance with this invention, a base of the channel for receiving the liner is provided with pocket means for receiving in interlocking engagement projecting portions of the flowed-in liner. The pocket means may be varied in configuration in accordance with the desired interlock.

An advantage of the construction of the interlock between the closure member and the flowed-in liner is that the necessary pocket means may be molded into the closure member during the normal forming of the closure member without the requirement of additional plastic material to form the closure member.

With the above and other objects in view that will hereinafter appear, the nature of the invention will be more clearly understood by reference to the following detailed description, the appended claims, and the several views illustrated in the accompanying drawings.

IN THE DRAWINGS

Figure 1:
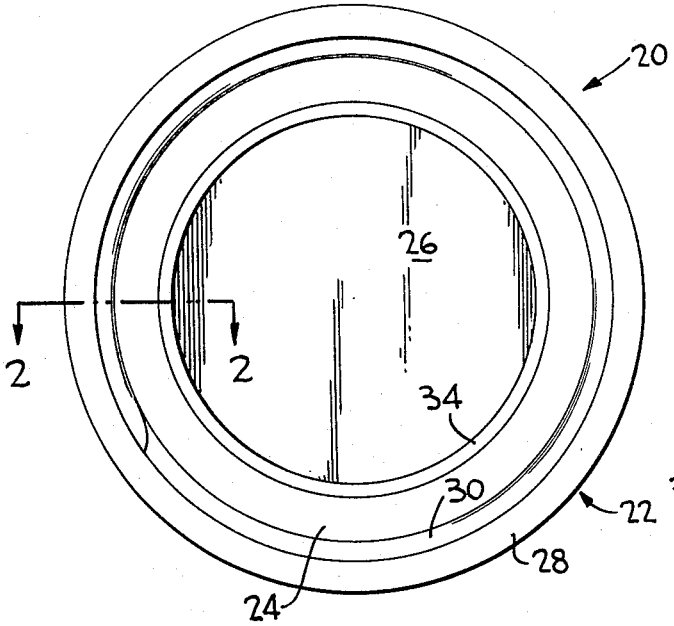
FIG. 1 is a bottom plan view of a closure assembly formed in accordance with the invention.
Figure 2:
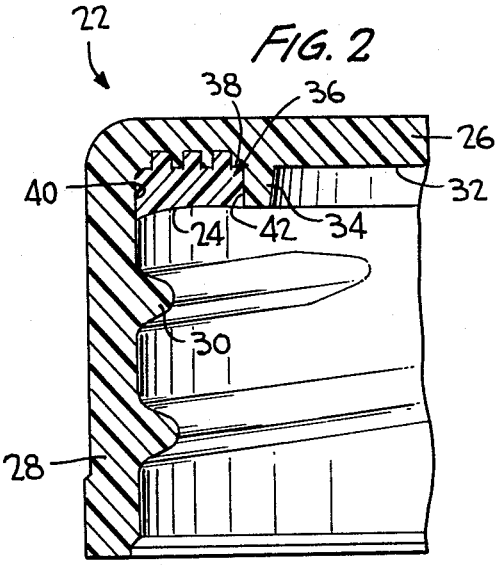
FIG. 2 is an enlarged fragmentary vertical sectional view taken generally along the line 2—2 of FIG. 1, and shows the cross section of the closure member and the interlock between the liner and the closure member.

Referring now to the drawings in detail, it will be seen that there is illustrated in FIGS. 1 and 2 a closure assembly in accordance with this invention. The closure assembly is generally identified by the numeral 20, and includes a closure member 22 having formed therein a sealing ring or liner 24.

As is best shown in FIG. 2, the closure member 22 includes an end panel 26 having depending from the periphery thereof a skirt 28. The skirt 28 has formed on the radial inner surface thereof threads 30 for the threaded interlocking with a neck finish of a container to be closed.

The end panel 26 has projecting downwardly from the lower or axially inner surface 32 thereof a projection 34 of a circular outline which is disposed concentric to the skirt 28. The projection 34 is illustrated as being in the form of an annular rib, but could be a solid projection.

There is defined in the upper outer corner of the interior of the closure member a channel 36. The channel 36 is defined by a base 38 which is the underside of the end panel 26, by an outer annular wall 40 which is the radial outer surface of the projection 34. The liner 24 is of a suitable plastic compound which is formed by flowing-in the plastic material thereof into the channel 36 with the liner 24 thus being formed in situ.

In accordance with this invention, it is desired to interlock the liner 24 with the closure member 22 so as to prevent movement between the two. Thus, the base 38 is formed with pocket means into which portions of the material of the liner 24 flow during the formation of the liner 24. These pocket means serve not only to interlock the liner against movement relative to the closure member, but also help prevent lateral or shear action between the liner and the closure member due to relative internal package pressure.

Figure 3:
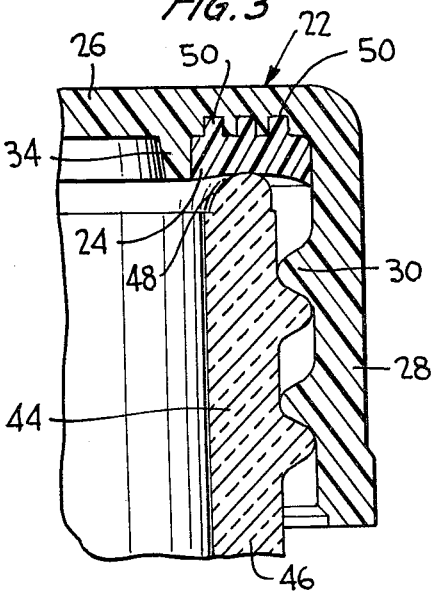
FIG. 3 is an enlarged fragmentary vertical sectional view taken through the neck finish of a container having the closure assembly of FIGS. 1 and 2 applied thereto, finger-tight.
Figure 4:
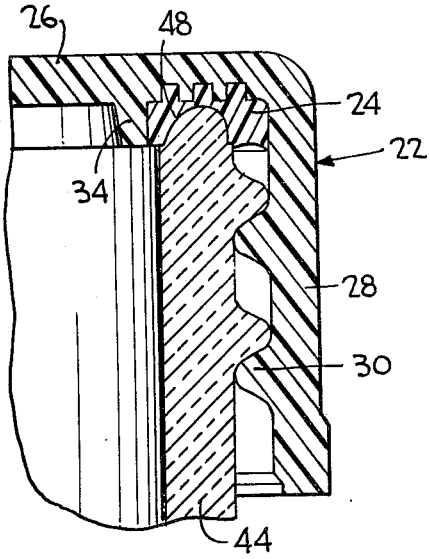
FIG. 4 is a sectional view similar to FIG. 3, showing the closure assembly fully applied to the container with the finish of the container compressed into the liner.

Referring now to FIGS. 3 and 4, it will be seen that the liner 24 will be maintained in place against movement relative to the closure member 22 at such time as the closure member is threaded onto a container neck finish of a container 46, and the liner 24 will be retained in place and only laterally compressed when the closure member 22 is applied to be finger-tight, as shown in FIG. 3. On the other hand, when the closure member is fully applied to the container 46, the liner will be compressed with the sealing finish 48 of the container 46 penetrating into the liner 24. This results in the portions of the liner 24 within the pocket means also being compressed and more tightly interlocking the liner with the closure member.

Figure 5:
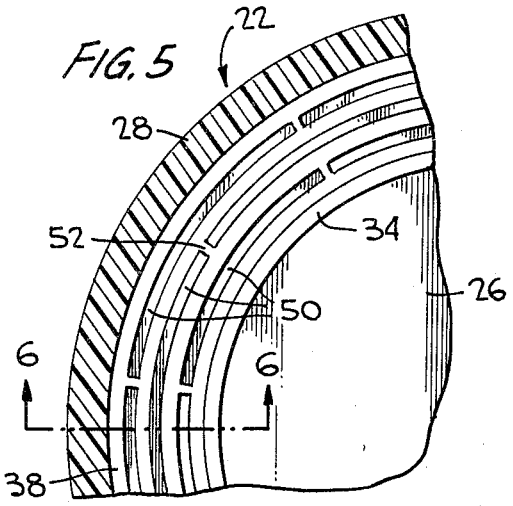
FIG. 5 is a fragmentary horizontal sectional view taken through the closure member of FIGS. 1–4, and shows the specific details of pocket means formed therein.
Figure 6:
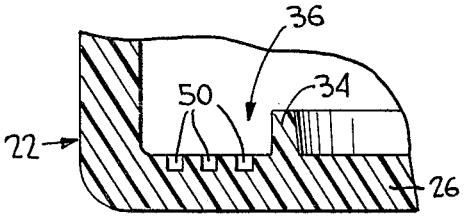
FIG. 6 is a fragmentary sectional view taken along the line 6—6 of FIG. 5, and shows further the details of the pocket means.

Referring now to FIGS. 5 and 6, it will be seen that the pocket means may typically be in the form of annular grooves 50 formed in the base 38. These annular grooves 50, as is best shown in FIG. 6, may be rectangular in cross section and may have a depth varying from 5 to 45% of the wall thickness of the end panel 26. If desired, the annular channels or grooves 50 may be interrupted at circumferentially spaced intervals by transverse walls or ribs 52.

Figure 7:
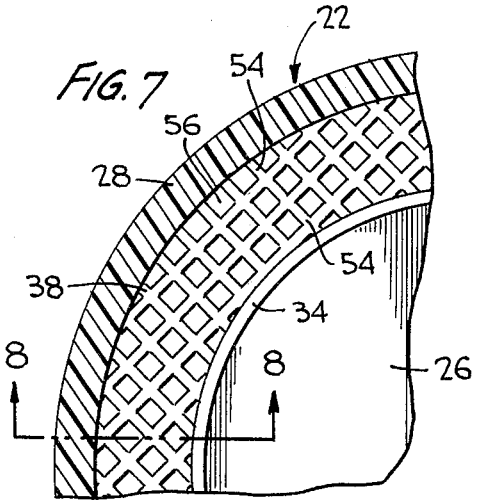
FIG. 7 is a view similar to FIG. 5, and shows a modified form of pocket means.
Figure 8:
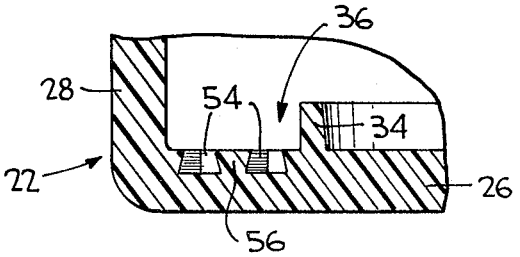
FIG. 8 is a fragmentary sectional view taken generally along the line 8—8 of FIG. 7, and shows further the details of the pocket means.

Referring now to FIGS. 7 and 8, it will be seen that the pocket means are of a different configuration. The base 38 is provided with a grid of intersecting channels 54 which define therebetween projecting islands 56.

The channels 54 are preferably dovetailed in cross section, as is best shown in FIG. 8. it will be seen that the channels 54 are straight line channels and are arranged in two series at right angles to each other.

Figure 9:
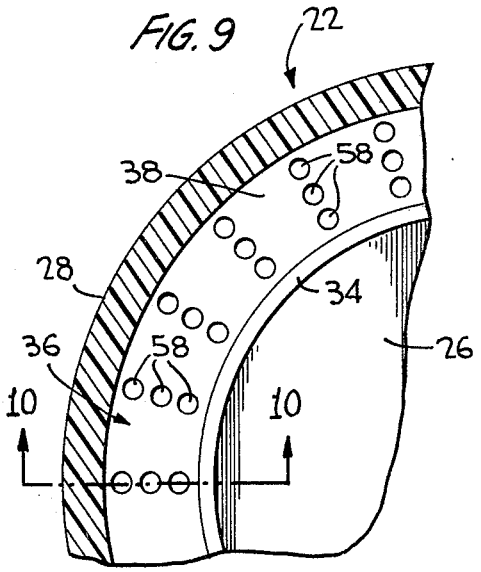
FIG. 9 is another view similar to FIG. 5, and shows yet another form of pocket means.
Figure 10:
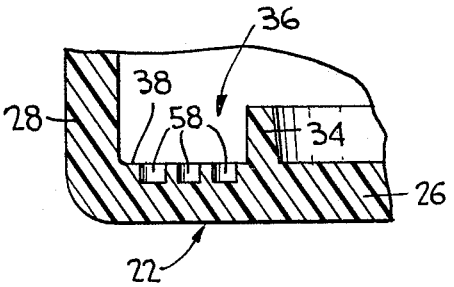
FIG. 10 is a fragmentary sectional view taken generally along the line 10—10 of FIG. 9, and shows further the details of the pocket means.

In FIGS. 9 and 10 there is illustrated yet another form of pocket means. The base 38 has formed therein a series of bores 58. Preferably, each series of bores 58 is in the form of a plurality of such bores arranged in a radial line with the series of bores being transversely spaced.

Although the bores 58 and the channels 50 have been illustrated as having parallel side walls, it is to be understood that the side walls could be sloped relative to each other so as to present a dovetailed cross section so as to provide for a firmer interlock.

Although only several preferred embodiments of pocket means have been specifically illustrated and described, it is to be understood that minor variations may be made in the pocket means to meet any specific requirements of the closure assembly.

It will be readily apparent from the foregoing disclosure that when the closure assembly formed in accordance with this invention is applied to a container wherein the product is packaged under pressure, such as a carbonated beverage, the interlock between the liner and the end panel will maintain the liner in sealed relation with there being no free path of flow of gases between the liner and the end panel. Therefore, by interlocking the liner with the closure member and preventing relative movement between the two, it will be seen that not only will a positive seal be maintained between the liner and the container neck finish, but also between the liner and the closure member.

Because the liner is compressed when the closure assembly is applied to a container, even if the product is packaged within the container at a sub-atmospheric pressure, the neck finish of the container will constantly urge the liner tightly against the base of its channel and maintain the required seal even under the conditions of a negative pressure.

Although only several preferred embodiments of the closure assembly have been specifically illustrated and described herein, minor variations may be made without departing from the spirit and scope of the invention as defined by the appended claims.

I claim:

1. A closure assembly comprising a plastic closure member and a liner seated in said closure member, said closure member having an internal annular channel, said liner being separately formed and seated in said channel, and there being a mechanical interlock between said liner and said closure member other than said liner being seated in said channel, said closure member including an end panel of which a portion defines a base of said channel, and said mechanical interlock including pocket means formed in said base and projecting portions of said liner seated in said pocket means, said pocket means being in the form of a grid of crossing channels.

2. A closure assembly according to claim 1 wherein said crossing channels are straight line channels defining a plurality of projecting islands.

3. A closure assembly according to claim 1 wherein said crossing channels are straight line dovetailed cross-sectional channels defining a plurality of projecting islands.

4. A closure assembly comprising a plastic closure member and a liner seated in said closure member, said closure member having an internal annular channel, said liner being separately formed and seated in said channel, and there being a mechanical interlock between said liner and said closure member other than said liner being seated in said channel, said closure member including an end panel of which a portion defines a base of said channel, and said mechanical interlock including pocket means formed in said base and projecting portions of said liner seated in said pocket means, said pocket means being in the form of a plurality of individual bores arranged in a plurality of circumferentially spaced radiating rows.

* * * * *